US005853904A

United States Patent [19]

Hall et al.

[11] Patent Number: 5,853,904

[45] **Date of Patent: *Dec. 29, 1998**

[54] HIGH TEMPERATURE ARTICLES

[75] Inventors: William G. Hall, Warborough; David C. Power, Linton, both of United Kingdom

[73] Assignee: Johnson Matthey Public Limited Company, London, England

[ * ] Notice: This patent issued on a continued prosecution application filed under 37 CFR 1.53(d), and is subject to the twenty year patent term provisions of 35 U.S.C. 154(a)(2).

[21] Appl. No.: 840,903

[22] Filed: Apr. 17, 1997

Related U.S. Application Data

[63] Continuation of Ser. No. 529,102, Sep. 15, 1995, abandoned.

[30] Foreign Application Priority Data

Sep. 16, 1994 [GB] United Kingdom ..... 9418705

[51] Int. Cl.[6] ..... F02K 9/97; C22C 5/00

[52] U.S. Cl. ..... 428/670; 420/461; 60/271

[58] Field of Search ..... 428/670, 660, 428/661; 420/461; 60/200.1, 271

[56] References Cited

U.S. PATENT DOCUMENTS

| | | | |
|---|---|---|---|
| 1,850,819 | 3/1932 | Waltenberg et al. | 420/461 |
| 3,210,167 | 10/1965 | Lacroix | 428/670 |
| 3,248,190 | 4/1966 | Woodward | 428/670 |
| 3,622,289 | 11/1971 | Hansen | 65/1 |
| 3,779,728 | 12/1973 | Hansen et al. | 65/1 |
| 3,855,972 | 12/1974 | Roberts | 123/8.09 |
| 3,984,717 | 10/1976 | Romanowski | 313/141 |
| 4,285,784 | 8/1981 | Flinn et al. | 204/39 |
| 4,288,982 | 9/1981 | Kuenzly et al. | 60/200 R |
| 4,441,904 | 4/1984 | Bhatti | 428/670 |
| 4,670,684 | 6/1987 | Kagawa et al. | 313/141 |
| 4,771,209 | 9/1988 | Ryan | 313/140 |
| 4,917,968 | 4/1990 | Tuffias et al. | 428/670 |
| 5,465,022 | 11/1995 | Katoh et al. | 313/144 |
| 5,613,299 | 3/1997 | Ring et al. | 29/890.01 |

FOREIGN PATENT DOCUMENTS

| | | | |
|---|---|---|---|
| 191618 | 8/1986 | European Pat. Off. | 428/670 |
| 2 492 806 | 4/1982 | France | C03B 37/08 |
| 1190266 | 4/1970 | United Kingdom | 428/660 |
| 1 350 644 | 4/1974 | United Kingdom | C03B 37/02 |
| 2 020 579 | 11/1979 | United Kingdom | B05B 1/00 |
| 2 118 078 | 10/1983 | United Kingdom | B22C 9/10 |

OTHER PUBLICATIONS

Massalski, American Society for Metals, vol. 2, pp. 1423, 1427, 1429, 1901 and 1905 (1986) (no month).

Patent Abstracts of Japan, vol. 014, No. 137 (JP–A–02 011734); vol. 014, No. 406 (JP–A–02 153053); vol. 002, No. 059 (JP–A–53–016400); vol. 005, No. 008 (JP–A–55 138040); vol. 010, No. 328 (JP–A–61 136929); vol. 003, No. 118 (JP–A–54 097584); vol. 009, No. 303 (JP–A–60 141382); vol. 009, No. 267 (JP–A–60 114560) (no dates).

Chemical Abstracts, vol. 79, No. 8, Abstract No. 48747; vol. 90, No. 10, Abstract No. 55369 (no date).

Derwent Publications, AN 173265 (no date).

*Primary Examiner*—John J. Zimmerman

*Attorney, Agent, or Firm*—Pillsbury Madison & Sutro LLP

[57] ABSTRACT

A high temperature article, for example a rocket nozzle suitable for liquid-fuelled rocket motors for satellites, is formed from an alloy which is a binary or tertiary alloy from the Pt-Ir-Rh system. Such alloys exhibit a good balance between ease and reliability of manufacture, cost of alloy and high temperature strength and oxidation resistance.

3 Claims, 1 Drawing Sheet

HIGH TEMPERATURE ARTICLES

This is a continuation of application Ser. No. 08/529,102, filed on Sep. 15, 1995, which was abandoned upon the filing hereof.

FIELD OF THE INVENTION

The present invention concerns improved high temperature articles, such as rocket nozzles.

Space vehicles, such as satellites, require many rocket motors and nozzles for positioning. These structures are usually operated at temperatures in excess of 2000° C. and are required to sustain substantial structural loads. At these temperatures, oxidation of the material generally occurs resulting in a decrease in efficiency. In general, materials capable of withstanding such high temperatures with minimal oxidation, do not have the strength to withstand substantial loads. Conversely, materials capable of withstanding substantial loads at those temperatures are generally subject to considerable oxidation. Consequently, rocket motors have been operated at below optimum temperatures in order to maintain structural strength with minimal oxidation. Even so, the life of such structures was generally limited.

DESCRIPTION OF THE PRIOR ART

Attempts have been made to overcome these problems. UK patent application GB 2,020,579A proposes the use of 10% by weight rhodium/platinum alloy for use in high-velocity gas streams, but this alloy has a markedly lower ability to withstand high operating temperatures. U.S. Pat. No. 4,917,968 uses an iridium/rhenium bi-layer composite, formed by chemical vapour deposition (CVD) of iridium onto a molybdenum mandrel followed by deposition of rhenium and dissolution of the molybdenum. A CVD process by its nature is generally limited to the application of pure metals and therefore gives no real opportunity to use the advantages of alloying.

There remains concern, however, within the aerospace industry about the reliability of the manufacturing process and the reliability of the nozzles formed by the above process. The investment in a satellite and its launch is such that there must be complete confidence in all parts.

Consequently there remains a need in the industry for alternative rocket nozzles having reliable and acceptable manufacturing methods combined with acceptable high temperature properties. It is desirable to be able to operate the rocket motor at as high a temperature as possible, since this equates to using less fuel for a given thrust, in turn permitting one or more of an increased payload, fuel load and the ability to maintain the satellite in position for an increased life.

SUMMARY OF THE INVENTION

The present inventors have found an alloy system which can withstand the high temperatures and loads required by the various applications. These alloy systems show good oxidation resistance and have the added benefit of greater ductility which gives improved fabricability, and more predictable failure mode.

Accordingly, the present invention provides a high temperature article prepared from an alloy capable of sustaining substantial temperatures and loads wherein said alloy is a binary or tertiary alloy from the system platinum/iridium/rhodium, provided that if the alloy is a binary rhodium/platinum alloy, the rhodium content is greater than 25% and that if the alloy is a binary platinum/iridium alloy, the iridium content is greater than 30%.

Figure 1:
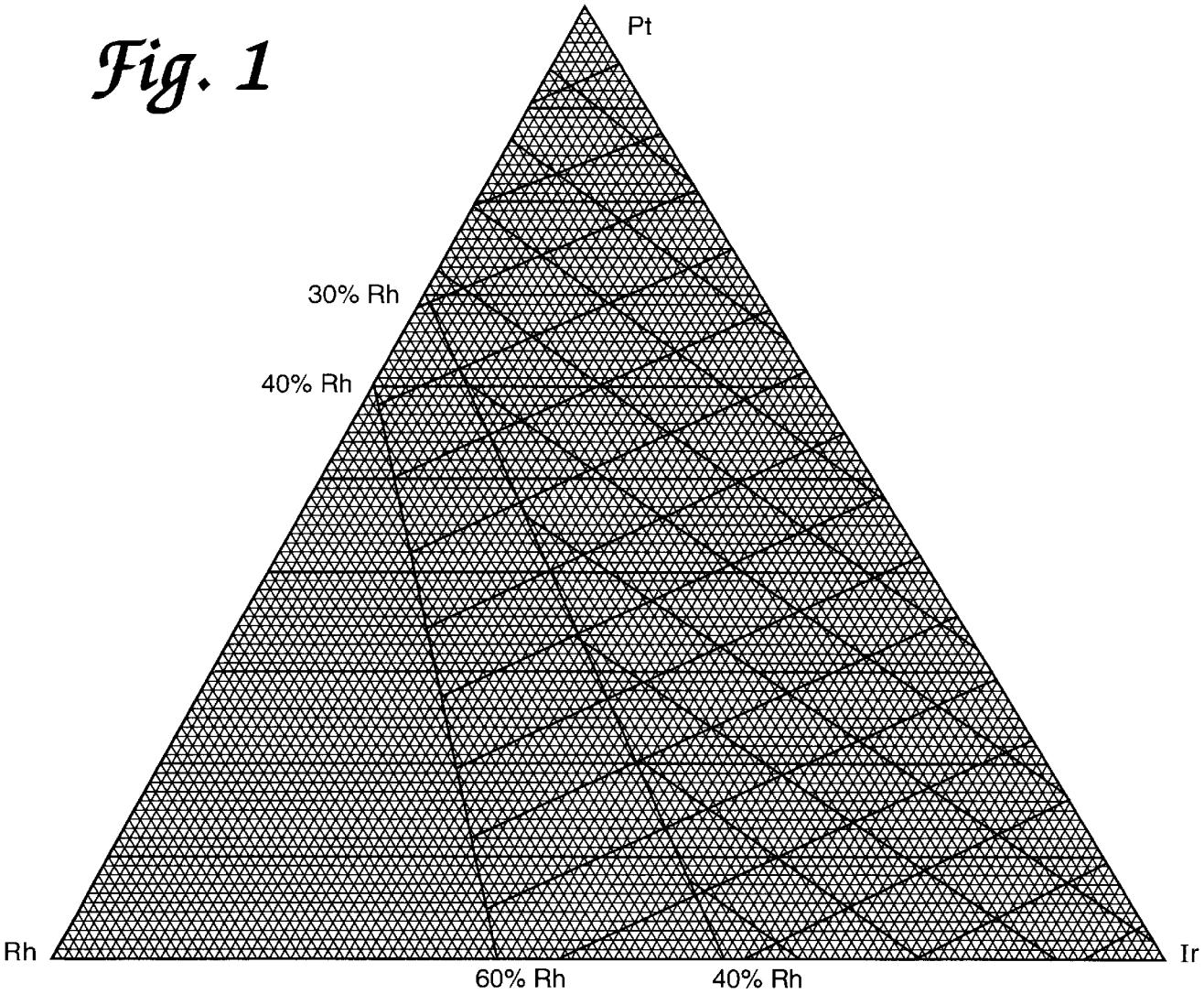
FIG. 1 is a triangular compositional diagram of alloys according to the invention.

Examples of suitable binary alloys are:

a) Rh/Ir in which the content of Rh is up to 60wt %, more preferably up to 40wt %;

b) Rh/Pt in which the content of Rh is from 25 to 40wt %, more preferably 25 to 30wt %;

c) Ir/Pt in which the content of Ir is 30 to 99.5wt %, preferably 30 to 40wt % or 60 to 99.5wt %.

Preferably the article is prepared from a Rh/Ir binary alloy, in which the Rh content is from 0.5 to 10 wt %, for example 2.5 to 5wt %.

Preferred tertiary alloys are those represented on the attached triangular compositional diagram (FIG. 1) as falling within the total hatched and cross-hatched area, and more preferred tertiary alloys are those falling within the cross-hatched area of the diagram.

The invention also encompasses modifications of the above alloys by the incorporation of a refractory metal such as rhenium or zirconium in an amount of up to 5% by wt, or the incorporation of other metal components providing that high temperature strength and oxidation resistance are not excessively adversely affected.

The invention further includes high temperature articles manufactured from the specified alloys and coated with a refractory metal or alloys thereof such as rhenium or tungsten/rhenium, for example by vacuum plasma spraying using conventional equipment, followed by hot isostatic pressing, or by a chemical or electrochemical deposition route.

Alternatively, the high temperature article may not be made completely from the above alloys, but may be a ceramic or metal article coated with one of the above alloys. Accordingly, an alternative embodiment of the present invention provides a coating for applying to a ceramic or metal, eg a refractory metal, substrate of a binary or tertiary alloy from the system platinum/iridium/rhodium, provided that if the alloy is a binary rhodium/platinum alloy, the rhodium content is greater than 25% and that if the alloy is a binary platinum/iridium alloy, the iridium content is greater than 30%.

The alloys specified form solid solutions and may be cast into ingots, forged, rolled, swaged, machined and/or drawn into tube, providing that robust tooling is used. For example, the alloy components may be melted in a vacuum furnace, although air furnaces may be used. Joining techniques used in platinum group metal metallurgy may be used.

Depending upon the properties of the alloy chosen, the high temperature article may be manufactured from tube or by forming sheet into the appropriate shape, by joining different shaped cone and tube shapes, by progressively forming (rolling) a flared cone from a tube, or possibly by die casting or machining from a casting. In all cases, a final shape may be achieved by machining. Alternatively, the article may be manufactured by coating a substrate with the alloy using plasma spraying, particularly vacuum plasma spraying, followed by removal of the substrate, for example by dissolving the substrate, oxidising or machining out the substrate. The particular wall thicknesses will depend upon the particular article being formed, but may be of the order of 0.040 in (approximately 1 mm) or less.

The high temperature articles of the invention show a good balance of oxidation resistance, high temperature strength and relative ease of manufacture, leading to reliability combined with acceptable production costs.

Suitable articles according to the present invention include rocket nozzles, spark plug electrodes, electrodes eg for glass melting applications, glass melting and forming apparatus eg crucibles, stirrers, fibrising equipment, core pinning wire for investment casting eg turbine blade manufacture, and lead-outs for halogen bulbs.

Preferably the articles of the present invention are rocket nozzles, which may be used for main thrusters or subsidiary thrusters (positioning rockets), and are preferably used with liquid fuel rockets.

DESCRIPTION OF PREFERRED EMBODIMENTS

The present invention will now be described by way of Example only.

Experimental Procedures

Ir metal and Ir-2.5%Rh and ir-5% Rh alloys were melted and alloyed in air before electron beam melting into ingots. Each of the wire-bar ingots were then hot forged, hot swaged and hot drawn to wire. The sheet ingots were hot forged and hot rolled to size.

Oxidation Tests

Furnace oxidation tests were performed on samples cut from sheet. Dimensional and weight measurements were performed before and after exposing these samples for 8 hours at 1450° C. This data was used to calculate oxidative weight loss per unit area per unit time for Ir, Ir-2.5%Rh and Ir-5% Rh. Results (in mg/cm$^2$/hr) (Table 1) clearly show that a Rh addition of only 2.5% is sufficient to more than halve the oxidation rate of Ir at 1450° C. Further improvement is achieved with an addition of 5% Rh. Microstructural analysis of cross sections through the tested samples did not reveal resolvable differences in oxide layer thickness.

Resistance heating of wire samples in flowing air was also performed to obtain comparative oxidation resistance at very high temperatures. This involved connecting a length of wire, nominally 1 mm diameter and 50mm long, between the terminals of a variable electrical supply. Distance between the electrical terminals was fixed to ensure that each test was performed under similar conditions. Current flowing through each wire sample was increased slowly until the desired test temperature was achieved. Temperature was measured using an optical pyrometer focused on the hottest section of the wire. Tests were conducted at temperatures of 1650°–1700° C. for 5–6 hours, 2050°–2100° C. for 40 minutes and 2200°–2250° C. for 20 minutes. Weight measurements were performed before and after each test. Size (surface area) of the hot zone was not known though was probably similar for each test condition. Results (Table 1) are therefore presented in the form of weight loss per unit time in order to illustrate comparative performance of the three materials under similar extreme conditions. Tests performed at 1650°–1700° C. corroborate the findings from the furnace oxidation tests, clearly demonstrating a halving of the oxidation rate of Ir by alloying with 2.5%Rh. Tests performed at 2025 –2100° C. demonstrate that improvements, albeit smaller, in oxidation resistance can be obtained until, at 2200°–2250° C., no difference in oxidation resistance was measured.

TABLE 1

| Ir/Rh Oxidation Behaviour | | | | |
|---|---|---|---|---|
| | Ir | Ir-2.5% Rh | Ir-5% Rh | units |
| Furnace oxidation tests | | | | |
| 8 hours at 1450° C. | 12.5 | 5.6 | 4.3 | mg/cm$^2$/hr |
| Resistance heating of wire samples | | | | |
| 1700° C. | 21 | 10 | 11 | mg/hr |
| 2050–2100° C. | 77 | 58 | 64 | mg/hr |
| 2200–2250° C. | 132 | 132 | 133 | mg/hr |

Hardness Tests

Vickers hardness tests were performed on polished microsections removed from sheet in the as-rolled condition and after 8 hours at 1450 ° C. The results are shown in Table 2.

TABLE 2

| Hardness | | | |
|---|---|---|---|
| | Ir | Ir-2.5% Rh | Ir-5% Rh |
| As-rolled | 536 | 530 | 566 |
| After 8 hours at 1450° C. | 309 | 309 | 294 |

Sheet Tensile Data

Tests were performed on dumbell samples using a servo-hydraulic tensometer. The test specimens were machined from as-rolled sheet using spark and wire erosion. Tests performed at strain rates of 0.016min$^{-1}$and 15.8min$^{-1}$ at 20° C. clearly demonstrated the significant increase in tensile strength and ductility that can be achieved through minor additions of Rh to Ir (Table 3). The retention of this high strength and ductility under high strain rate conditions is even more remarkable. At 1150° C. very large deformation was obtained in both of the Ir/Rh alloys (Table 4).

Wire Tensile Tests

Tensile tests were performed on as-drawn wire samples of Ir, Ir-2.5%Rh and Ir-5% Rh at room temperature. Wire diameter was nominally 1 mm and strain rate was 0.01 $min^{-1}$. Results (Table 5) for tensile elongation and reduction in area demonstrate significant improvement in the ductility of Ir by alloying with 5% Rh.

TABLE 3

Ir/Rh Sheet Tensile Data at 20° C.

| | Strain Rate | Yield Strength | | | Tensile Strength | | | Elong |
|---|---|---|---|---|---|---|---|---|
| Alloy | $min^{-1}$ | MPa | psi | tsi | MPa | psi | tsi | % |
| Ir | 0.016 | approx 740 | | | 714 | 107,735 | 48 | 2.8 |
| Average | | 740 | | | 743 | | | 2.8 |
| | 15.8 | | | | 761 | 110,345 | 49 | 1.9 |
| | 15.8 | | | | 713 | 103,385 | 46 | 1.7 |
| Average | | | | | 737 | | | 1.8 |
| 2.5% Rh/Ir | 0.016 | 931 | | | 1097 | 159,065 | 71 | 5.3 |
| | 0.016 | 938 | | | 1088 | 157,760 | 70 | 4.1 |
| Average | | 935 | | | 1093 | | | 4.7 |
| | 15.8 | | | | 1314 | 190,630 | 85 | 10.5 |
| | 15.8 | | | | 1177 | 170,665 | 76 | 6.8 |
| Average | | | | | 1246 | | | 8.7 |
| 5% Rh/Ir | 0.016 | 1080 | | | 1307 | 189,515 | 85 | 8.5 |
| | 0.016 | 1107 | | | 1425 | 206,625 | 92 | 12.7 |
| | 0.016 | 1093 | | | 1395 | 202,276 | 90 | 12.3 |
| | | 1093 | | | 1376 | | | 11.2 |
| | 15.8 | | | | 1431 | 207,495 | 93 | 13.8 |
| | 15.8 | | | | 1431 | 207,495 | 93 | 12.6 |
| Average | | | | | 1431 | | | 13.2 |

Strain rate = Variable; Specimens = sheet dumbell; As rolled

TABLE 4

Ir/Rh Sheet Tensile Data at 1150° C.

| | Strain Rate | Tensile Strength | | | Elong |
|---|---|---|---|---|---|
| Alloy | $min^{-1}$ | MPa | psi | tsi | % |
| Ir | 0.016 | 315 | 45,675 | 20 | 17 |
| Average | | 315 | | | 17 |
| 2.5% Rh/Ir | 0.016 | 215 | 31,175 | 14 | 57 |
| | 0.016 | 193 | 27,985 | 12 | 70 |
| Average | | 204 | | | 64 |
| 5% Rh/Ir | 0.016 | 191 | 27,695 | 12 | 59 |
| | 0.016 | 205 | 29,725 | 13 | 73 |
| | 0.016 | 220 | 31,900 | 14 | 54 |
| | | 205 | | | 62 |

Strain rate = 0.016 $min^{-1}$; Specimens = sheet dumbell; As-rolled.

TABLE 5

Ir/Rh - Wire Tensile Data

| | Yield Strength | | | Tensile Strength | | | Elong | R of A | |
|---|---|---|---|---|---|---|---|---|---|
| Alloy | MPa | psi | tsi | MPa | psi | tsi | % | % | Comments |
| Ir | BRO712 0.89 mm diameter as drawn wire | | | | | | | | |
| | | | | 1869 | 271,005 | 121 | 13.2 | 13 | fracture at 45 degrees |
| | | | | 1835 | 266,075 | 119 | 10 | 10 | |
| | | | | 1869 | 271,005 | 121 | 10.3 | 11 | broke in jaws |
| | | | | 1906 | 276,370 | 123 | 16.2 | 17 | |
| | | | | 1872 | 271,440 | 121 | 7.8 | 1 | broke in jaws |
| Average | 1648 | 2 3 8 , 960 | 107 | 1870 | 271,179 | 121 | 11.5 | 10.4 | |
| Standard dev | | | | 25 | | | 3.2 | 5.9 | |

| | Yield Strength | | | Tensile Strength | | | Elong | R of A | |
|---|---|---|---|---|---|---|---|---|---|
| Alloy | MPa | psi | tsi | MPa | psi | tsi | % | % | Comments |
| 2.5% Rh/Ir | BRO888 1.05 mm diameter, as drawn wire | | | | | | | | |
| | | | | 1483 | 215,035 | 95 | 3.7 | 11 | flat, 0 degree brittle type fracture |
| | | | | 1511 | 219,095 | 97.8 | 5.6 | 13 | |
| | | | | 1560 | 226,200 | 101 | 7.1 | 14 | |
| | | | | 1565 | 226,925 | 101 | 6.9 | 15 | broke in jaw |
| | | | | 1623 | 235,335 | 105 | 12.2 | 19 | |
| | | | | 1518 | 220,110 | 98.3 | 8.1 | 15 | broke in jaws |
| | | | | 1560 | 226,200 | 101 | 7.7 | 14 | broke in jaws |
| | | | | 1536 | 222,720 | 99.5 | 7.3 | 15 | broke in jaws |
| | | | | 1527 | 221,415 | 98.9 | 10.9 | 16 | broke in jaws |
| | | | | 1567 | 227,215 | 101 | 7.5 | 14 | |
| Average | 1363 | 197,635 | 88.3 | 1545 | 224,025 | 100 | 7.7 | 14.6 | |
| Standard dev | | | | 39 | | | 2.4 | 2.1 | |

| | Yield Strength | | | Tensile Strength | | | Elong | R of A | |
|---|---|---|---|---|---|---|---|---|---|
| Alloy | MPa | psi | tsi | MPa | psi | tsi | % | % | Comments |
| 5% Rh/Ir | BR2489 1.06 mm diameter as drawn wire | | | | | | | | |
| | | | | 1784 cup-cone type fracture | 258,680 | 116 | 28.1 | 40 | Notable necking with fibrous |
| | | | | 1837 | 266,365 | 119 | 34.9 | 45 | broke in jaws |
| | | | | 1840 | 266,800 | 119 | 16.5 | 22 | broke in jaws |
| | | | | 1764 | 255,780 | 114 | 26.9 | 35 | |
| | | | | 1804 | 261,580 | 117 | 24.2 | 37 | broke in jaws |
| Average | 1501 | 217,645 | 97.2 | 1806 | 261,841 | 117 | 26.1 | 35.8 | |
| Standard dev | | | | 33 | | | 6.7 | 8.6 | |

We claim:

1. A rocket nozzle consisting essentially of a binary alloy of from 0.5 to 10 wt % rhodium and the remainder being iridium, said alloy being characterized by its ability to withstand the combination of high temperatures in excess of 1150° C. and structural loads.

2. A rocket nozzle according to claim 1 wherein the rhodium content is from 2.5 to 5 wt %.

3. A liquid-fuelled rocket motor suitable for use with satellites or other space vehicles, comprising a rocket nozzle according to claim 1.

* * * * *